US007892152B1

(12) United States Patent
Teng

(10) Patent No.: US 7,892,152 B1
(45) Date of Patent: Feb. 22, 2011

(54) STRUCTURAL IMPROVEMENT FOR STRETCHING EXERCISE APPARATUS

(76) Inventor: Ju-Chuan Teng, P.O. Box 215, Taichung (TW) 40099

( * ) Notice: Subject to any disclaimer, the term of this patent is extended or adjusted under 35 U.S.C. 154(b) by 0 days.

(21) Appl. No.: 12/591,519

(22) Filed: Nov. 23, 2009

(30) Foreign Application Priority Data

Aug. 14, 2009 (TW) ..... 98215054 U

(51) Int. Cl.
*A63B 23/08* (2006.01)

(52) U.S. Cl. ..... 482/79; 482/142; 482/148; 482/62

(58) Field of Classification Search ..... 482/62, 482/34, 79, 146, 141, 142, 140, 148, 139, 482/70–72, 51, 92; D21/662, 665
See application file for complete search history.

(56) References Cited

U.S. PATENT DOCUMENTS 3,584,871 A * 6/1971 Kelmon et al. ..... 482/123
3,791,645 A * 2/1974 Stelma ..... 482/71
4,111,417 A * 9/1978 Gardner ..... 482/128
4,340,214 A * 7/1982 Schutzer ..... 482/51
4,506,884 A * 3/1985 Hankin ..... 482/131
4,619,454 A * 10/1986 Walton ..... 482/128
4,669,723 A * 6/1987 Arsenian ..... 482/71
4,743,014 A * 5/1988 Loane ..... 482/71
5,147,257 A * 9/1992 Loane ..... 482/71
5,147,266 A * 9/1992 Ricard ..... 482/131
D335,512 S * 5/1993 Gvoich ..... D21/662
5,222,928 A * 6/1993 Yacullo ..... 482/71
5,279,530 A * 1/1994 Hess ..... 482/70
5,299,996 A * 4/1994 Chi ..... 482/70
5,328,427 A * 7/1994 Sleamaker ..... 482/71
5,749,811 A * 5/1998 Wilson ..... 482/71
6,186,930 B1 * 2/2001 Ignaczak ..... 482/141
6,280,366 B1 * 8/2001 Hsieh ..... 482/130
6,368,254 B1 * 4/2002 Wall ..... 482/71
6,514,180 B1 * 2/2003 Rawls ..... 482/70
6,716,145 B1 * 4/2004 Manailovich ..... 482/141
D512,111 S * 11/2005 Summers ..... D21/668
7,090,621 B2 * 8/2006 Loane ..... 482/71
7,108,643 B2 * 9/2006 Wilson et al. ..... 482/141
7,125,367 B1 * 10/2006 Stearns ..... 482/141
7,134,987 B2 * 11/2006 Goldstein ..... 482/141
D550,312 S * 9/2007 Summers ..... D21/668
7,294,100 B2 * 11/2007 Bull ..... 482/51
7,303,511 B2 * 12/2007 Bull ..... 482/71
7,419,459 B2 * 9/2008 Van Straaten ..... 482/70
7,438,673 B1 * 10/2008 Jones ..... 482/71
D589,573 S * 3/2009 McVay et al. ..... D21/668

(Continued)

*Primary Examiner*—Lori Baker

(57) ABSTRACT

A structural improvement for stretching exercise apparatus comprises a carry handle pivotally connected symmetric long bottom seats, upper surfaces of the long bottom seats having symmetric guiding slots near two long side edges; at least two sets of symmetric casters, disposed to bottom portions of two pedals, for fitting the symmetric guiding slots; and two flexible riggings disposed inside the two long bottom seats. The feature of the apparatus is that a long channel is disposed between the symmetric guiding slots and upper surfaces of the symmetric long bottom seats. A plurality of symmetric positioning circular holes is disposed to two sides of the long channel. A limit seat has four end angles equipped with cylinders. Accordingly, the distance variations generated by the pedal relatively moving within the guiding slot can be changed by regulating the cylinders of the limit seat inserted into the positioning circular holes at different positions.

11 Claims, 11 Drawing Sheets

U.S. PATENT DOCUMENTS

| | | | | |
|---|---|---|---|---|
| 7,556,592 | B2 * | 7/2009 | Nizam | 482/70 |
| 7,645,218 | B2 * | 1/2010 | Potok | 482/141 |
| 2004/0053752 | A1 * | 3/2004 | Yang | 482/70 |
| 2004/0204293 | A1 * | 10/2004 | Andreasen | 482/52 |
| 2004/0242381 | A1 * | 12/2004 | Parmater | 482/71 |
| 2005/0148448 | A1 * | 7/2005 | Mersch | 482/141 |
| 2005/0227836 | A1 * | 10/2005 | Wen | 482/141 |
| 2007/0117693 | A1 * | 5/2007 | Ilioi | 482/121 |
| 2009/0176631 | A1 * | 7/2009 | Blessing | 482/71 |

* cited by examiner

STRUCTURAL IMPROVEMENT FOR STRETCHING EXERCISE APPARATUS

FIELD OF THE INVENTION

The invention relates to a structural improvement for stretching exercise apparatus that provides two feet of a user respectively standing on symmetric pedals and then configures the symmetric pedals based upon self demands of the user to achieve the goal of exercising leg functions of the user thorough resistance forces generated by outwardly unfolding or inwardly folding the pedals at the same time.

BACKGROUND OF THE INVENTION

A conventional exercise structure, entitled as "Multifunctional sliding fitness equipment", includes a bottom plate taken as a main body. Sliding rails are formed on the bottom plate. A pair of foot pedals having casters is crossed over the rails of the bottom plate. The characteristics of the exercise structure are that: the bottom plate is butted with two long strip plates and connected with a hinge. The hinge toggle joint disposed to other surfaces of the two long strip plates are passed by a flexible rope. A hanging ring is further formed at a tail of the long strip plate so that the flexible rope formed between a pull ring and a hanging hook can be hanged to the hanging ring of the long strip plate through the hanging hook, thereby forming a structure having the flexible rope at two sides of the bottom plate. A pair of fixed insertion holes is formed at a tail section of the long strip plate and inserted with a blocking rack to prevent the foot pedals from sliding out of the rails of the bottom plate. Several pairs of regulation holes are further disposed to the plate surface of the long strip plates based on proper intervals and selectively passed by the blocking rack so as to regulation the sliding distance generated by the foot pedals on the bottom plate. Two foot pedals can be connected by several flexible ropes as well. Locking holes are formed at a head and a tail of the foot pedal simultaneously and provided for locking grips at the head and tail of the foot pedal. Since rollers disposed to a bottom portion of the foot pedals are fit to the sliding rails of the bottom plates, the foot pedals may not come off the sliding rails because of the influence of outer forces.

However, the foregoing sliding fitness equipment has some problems that need to be overcome. After folding the bottom plate pivotally composed of the two long strip plate, there is no handle design for carry. Although many regulation holes disposed to relative outer ends of the bottom plate can be passed by the blocking rack, the defect of difficultly inserting the blocking rack into the regulation holes under tightening condition may happen. The blocking rack may be loosened under loosening condition and result in noise while touching the blocking rack. If the two foot pedals are not blocked by the blocking rack, the foot pedals are not positioned to the predetermined position of the rails on the bottom plate via the complete control of the user. Consequently, while performing expansion or drawing close to each other, the foot pedals may be improperly shifted toward a single side of the bottom plate due to non-uniform applied force and subsequent exercises are impeded. The flexible ropes between the two foot pedals appear on an upper surface of the bottom plate without any beauty. When the flexible ropes generate elastic fatigue, the flexible ropes may easily fall into the rails to form the obstruction that the rollers disposed to the bottom portion of the foot pedals may not smoothly pass through during stretching and retracting processes. The user may easily fall from the fitness equipment to suffer injuries.

Therefore, to overcome the foregoing shortcomings, the inventor(s) of the invention based on years of experience in the related field to conduct extensive researches and experiments, and finally invented a structural improvement for stretching exercise apparatus.

SUMMARY OF THE INVENTION

A primary objective of the invention is to provide a structural improvement for stretching exercise apparatus that could regulate symmetric pedals to unfold toward outside or to fold toward inside simultaneously so as to achieve the variation for stroke distance.

Another objective of the invention is to provide a structural improvement for stretching exercise apparatus. When the symmetric pedals slide along paths stroke, elastic pads are fixedly disposed to two terminals of the path strokes and lean against the pedals to absorb shock and to generate buffer effect.

To achieve the foregoing objectives, the structural improvement for stretching exercise apparatus of the invention comprises a carry handle connected to symmetric long bottom seats at two sides of a pivot seat of the carry handle, symmetric roller sets fixedly disposed to a central position at two short side edges of the long bottom seat, upper surfaces of the long bottom seats having symmetric guiding slots near two long side edges of the long bottom seats; two pedals, two sets of symmetric casters, spaced at equivalent intervals and disposed to bottom portions of the pedals, for directly sliding in the symmetric guiding slots, two sets of symmetric fastening slots disposed to a relative outer side of an upper portion of the pedal; two flexible riggings disposed inside of the long bottom seats, and more than one blocking member respectively connected to two ends of the long bottom seats and capable of being blocked between the correspondingly roller sets and two outer sidewalls of the long bottom seat, wherein the blocking member at any side as the left side or the right side is fastened in the fastening slot of the corresponding end of the pedal by simultaneously selecting the two flexible riggings so that the pedal can generate a damper effect while outwardly displacing or inwardly displacing. The pedal can return to the original position through the flexible riggings. Alternatively, the blocking members at the right and left sides of the long bottom seat are fastened in the fastening slots of the two sides of the pedals for limiting to allow the pedals to perform a phase positioning along the guiding slots. The feature of the invention is that:

More than long channel is disposed between the symmetric guiding slots of upper surface of the symmetric long bottom seats. A plurality of symmetric positioning circular holes is spaced at equivalent intervals and disposed to two sides of the two long channels near correspondingly outer ends of the long bottom seats. A limit seat has four cylinders at four end angles of the limit seat. The four cylinders at the four end angles are exactly fit to the plurality of positioning circular holes at the two sides of the long channel. A side of an upper end of the limit seat has a flexible pad for leaning against a relative edge of the pedal so that the variations of stroke distance generated by the pedal relatively moving within the guiding slot can be changed by regulating the cylinders of the limit seat inserted into the positioning circular holes at different positions.

Moreover, an elastic pad is respectively disposed to terminals of two short side edges of each long channel on the long bottom seat and is provided for leaning against the casters of the bottom portion of the pedal to absorb shocks and to generate buffer effect.

BRIEF DESCRIPTION OF THE DRAWINGS

FIGS. 1-1 is a bottom view of a limit seat of the structure according to a preferred embodiment of the invention;

FIGS. 1-2 is a schematic diagram of rotating a regulation member relative to the limit seat at different positions I;

FIGS. 1-3 is a schematic diagram of rotating a regulation member relative to the limit seat at different positions II;

FIG. 2 is an assembly drawing of the structure according to a preferred embodiment of the invention;

FIG. 3 is an assembly side view of the structure according to a preferred embodiment of the invention;

DETAILED DESCRIPTION OF THE PREFERRED EMBODIMENTS

Figure 1:
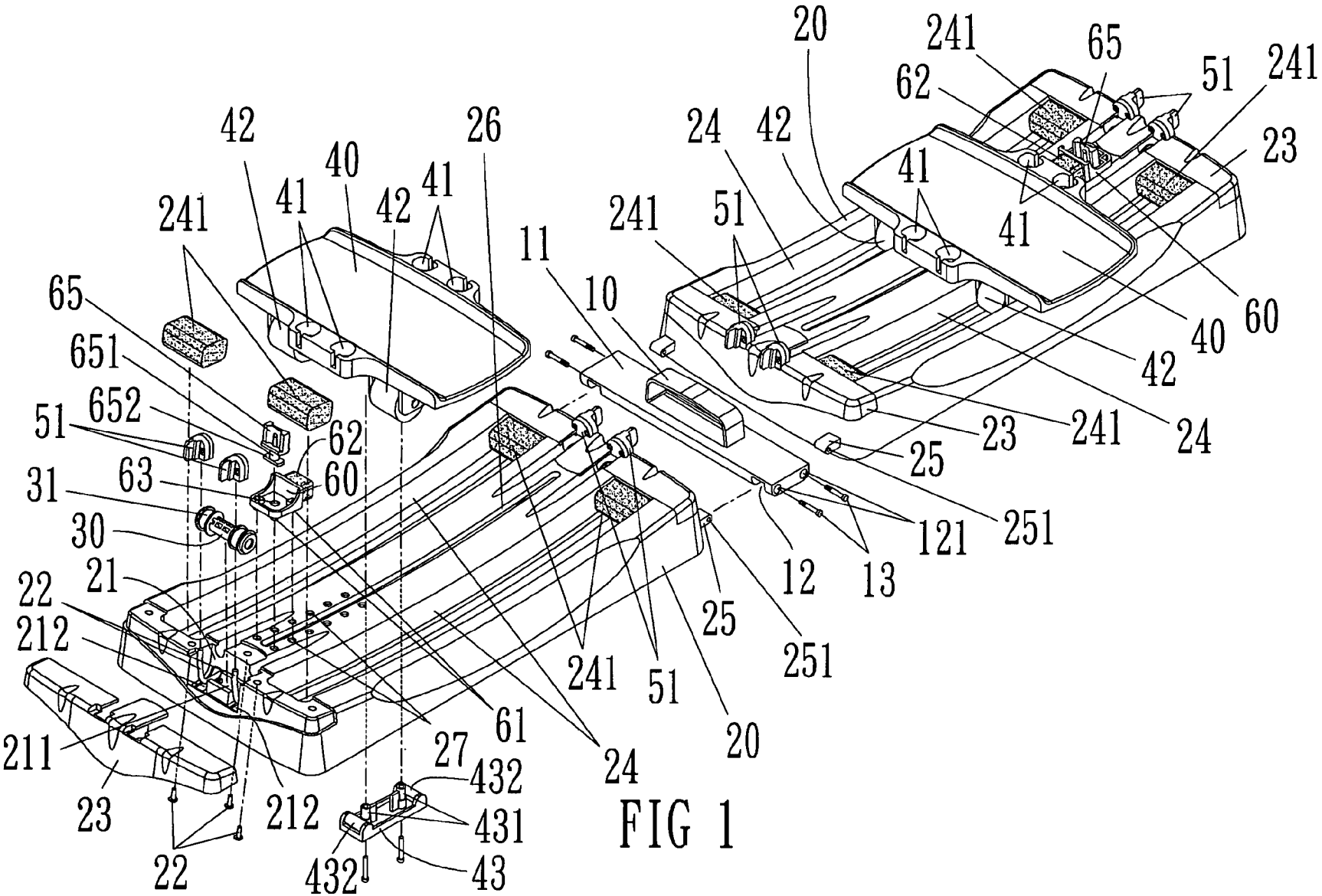
FIG. 1 is a decomposition chart of a structure according to a preferred embodiment of the invention.
Figure 1:
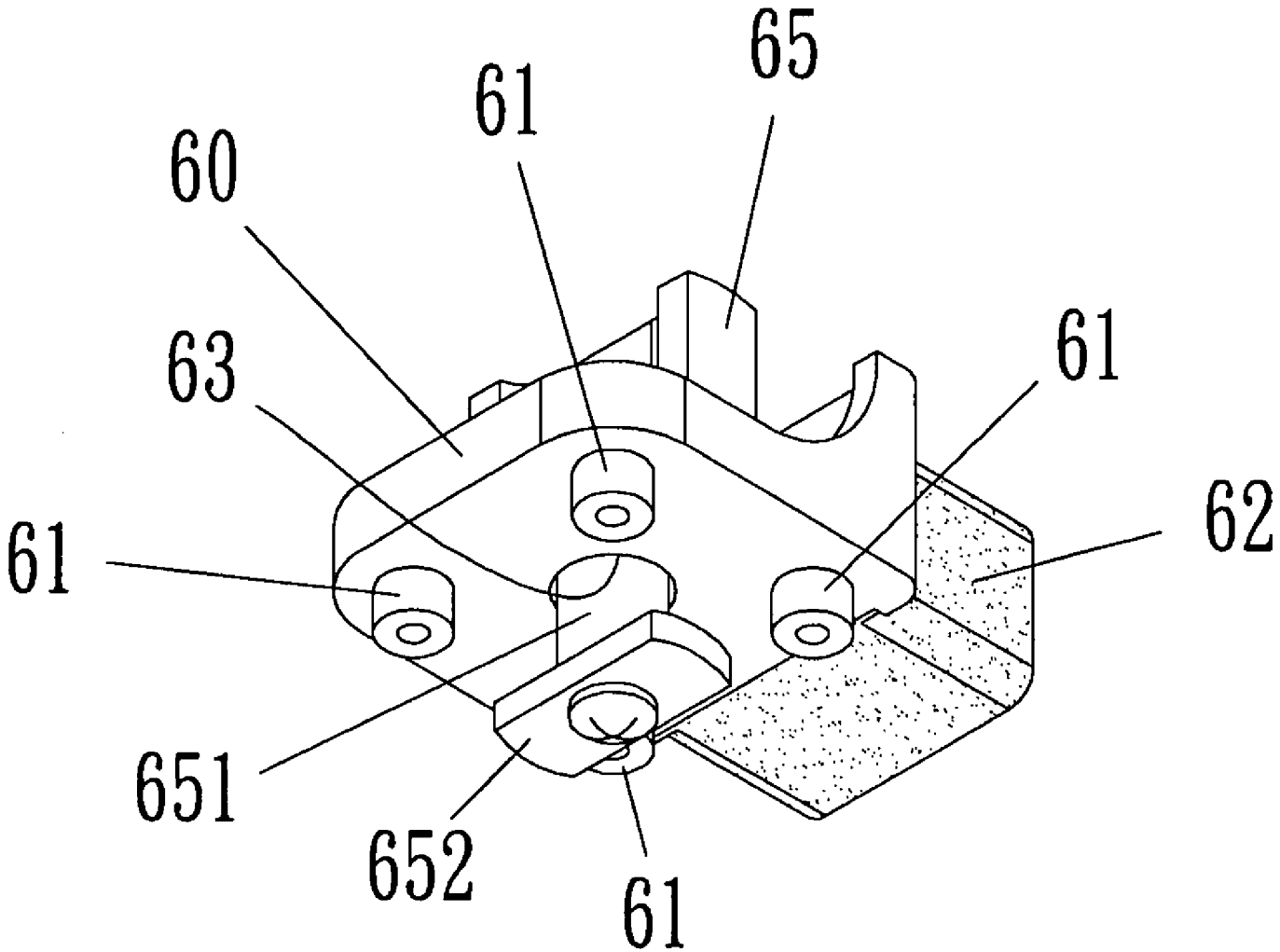

Other features and advantages of the present invention will become apparent from the following description of the invention which refers to the accompanying drawings.

Please refer to FIG. 1 to FIG. 9, a structural improvement for stretching exercise apparatus comprises a carry handle 10, two long bottom seats 20, a plurality of roller sets 30, two pedals 40, a plurality of flexible riggings 50 and two limit seats 60.

The carry handle 10 has a pivot seat 11 formed at a bottom portion of the carry handle 10. Symmetric cross notches 12 where openings are outward are disposed to two sides of the pivot seat 11. Symmetric pivot holes 121 are disposed to two sides of each cross notch 12 to respectively pivot and connect symmetric convex ears 25 of corresponding ends of the two long bottom seats 20 at two sides of the pivot seat 11 by incorporating with axle rods 13.

Figure 9:
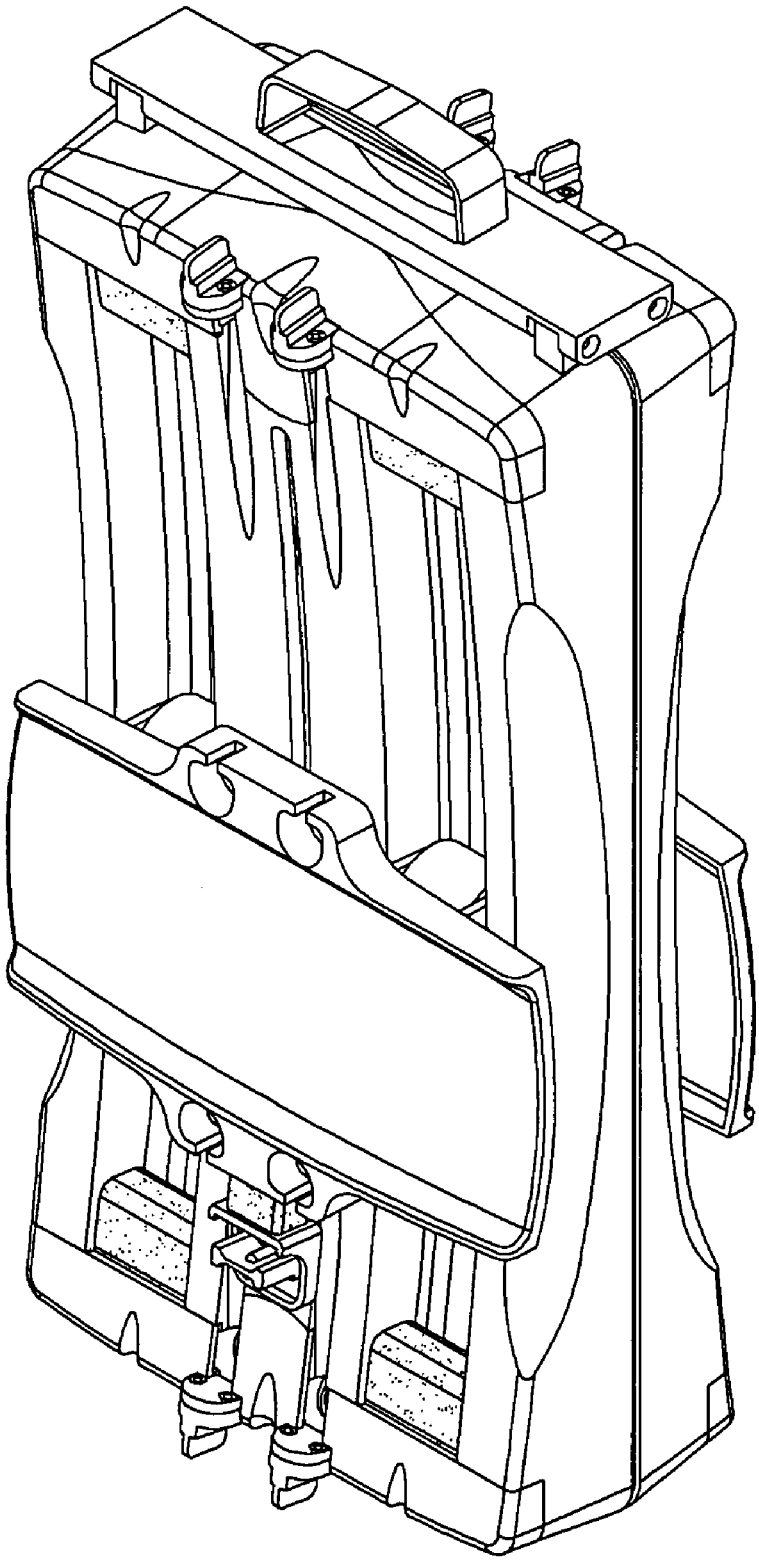
FIG. 9 is a schematic diagram of folding and unfolding the structure according to a preferred embodiment of the invention.

Symmetric containing notches 21 where openings are upward are disposed to a central position of two short side edges of the long bottom seat 20 and are provided for containing roller sets 30. A bottom of the containing notch 21 has a limit gutter 211 for hooping the roller set 30. Two sides of the limit gutter 211 have a via 212 passed by the flexible rigging 50 and an outer cover 23 is covered with an upper end of the containing notch 21 by incorporating with a plurality of locking components 22 so that the roller set 30 can be positioned between the limit gutter 211 and the outer cover 23. In addition, symmetric guiding slots 24 are disposed to two long side edges at an upper surface of the long bottom seat 20 to limit and contain the casters 42 correspondingly pivoted to the pedal 40. Two ends of each guiding slot 24 have elastic pad 241 for leaning against the caster 42 to absorb shock and to generate buffer effect. The foregoing elastic pad 24 shown in the embodiment is a rubber pad that is adhered to a predetermined position of the guiding slot 24 through glue. Moreover, the symmetric convex ears 25 are disposed to a short side edge of the long bottom seat 20 and can align and fit the symmetric cross notches 12 of the carry handle 10. Each convex ear 25 has a pivot hole 251 passed by the axle rod 13 to allow the long bottom seat 20 to pivotally connect the carry handle 10 as a whole. The apparatus can be unfolded as a horizontal state or can be folded as a vertical state (as shown in FIG. 9) without occupying spaces. Further, upper surfaces of the symmetric long bottom seats 20 have more than one long channel 26 between the symmetric guiding slots 24. A plurality of symmetric positioning circular holes 27 is spaced at equivalent intervals and disposed at two sides of the two long channels 26 near correspondingly outer ends of the symmetric long bottom seats 20.

A central section of the roller sets 30 can be fit to the limit gutter 211 of the foregoing containing notches 21. Symmetric concave rollers 31 are disposed to two sides of the roller set 30 and can be wound by the flexible riggings 50.

The two pedals 40 can be respectively installed to the upper portions of the two long bottom seats 20. Two sets of symmetric fastening slots 41 are disposed to two sides of an upper surface of the pedal 40 corresponding to two short edges of the long bottom seat 20 and provided for containing blocking members 51 of the flexible riggings 50. Moreover, two sets of symmetric casters 42 are disposed to a bottom portion of the pedal 40 and can be respectively placed into the symmetric guiding slots 24 of the long bottom seat 20. In addition, a limit plate 43 is locked to a center position of the bottom portion of the pedal 40. Symmetric connection cylinders 431 are disposed to an upper end of the limit plate 43 and can be contained into the long channel 26 of the long bottom seat 20. A width of the limit plate 43 is greater than a width of the long channel 26 so that the pedal 40 may not come off the long channel 26 through the blocking of the limit plate 43. Further, two sides of the limit plate 43 have two wheel axles 432. A portion of upper surfaces of the two wheel axles 432 can attach a bottom surface of the long channel 26 so that the pedal 40 can smoothly slide along the long channel 26.

The two flexible riggings 50 are assembled in every long bottom seat 20. Two ends of every flexible rigging 50 respectively correspond to a through hole 212 from two sides of the containing notches 21 on two ends of the long bottom seat 20 and pass through the concave rollers 31 of the roller sets 30 and connected a blocking member 51 at end portion. The blocking member 51 leans against an upper surface of the outer cover 23.

Mutually symmetric cylinders 61 are disposed to four end angles of a bottom portion of the limit seat 60. The cylinders 61 of the four end angles are exactly fit to the plurality of positioning circular holes 27 at two sides of the long channel 26. A flexible pad 62 is disposed to a side of an upper end of the limit seat 60 and is provided for leaning against a corresponding edge of the pedal 40. A circular aperture 63 is further disposed to another side of the upper end of the limit seat 60. Symmetric blocking pieces 64 are disposed to a predetermined inclined diagonal at a circumference of the circular aperture 63. A circular cylinder 651 is extended from a bottom portion of the regulation member 65 and can be fit to the circular aperture 63 to perform angle rotation. A long blocking plate 652 is formed to a terminal of the circular cylinder 651. A short edge of the long blocking plate 652 is smaller than the width of the long channel 26 on the long bottom seat 20. A long edge of the long blocking plate 652 is greater than the width of the long channel 26.

With the foregoing component assembly, the invention provides a user to freely select the blocking member 51 of any side synchronously connected to the flexible rigging 50 to contain in the fastening slot 41 of the corresponding end of the pedal 40 so that when the pedal 40 displaces, a damper effect is synchronously generated by stretching the flexible rigging 50. After the flexible rigging 50 is stretched, the force storage effect then is released and the pedal 40 then is automatically pulled back to original position. Alternatively, the blocking members 51 connected to the flexible riggings 50 can be simultaneously selected to contain in the fastening slots 41 of the corresponding ends of two sides of the pedal 40 so that when the pedal 40 displaces, there is no any generated damper effect. The goal of real time positioning at any phase can be achieved. Moreover, by means of simultaneously regulating each cylinder 61 of the limit seat 60 inserted into the positioning circular holes 27 of the long bottom seat 20, the flexible pad 62 disposed at a side of the limit seat 60 is utilized for leaning against the corresponding edge of the pedal 40, thereby changing the variations of the stroke distance generated by the pedal 40 relatively moving within the guiding slot 24.

Figures 1, 2, 3:
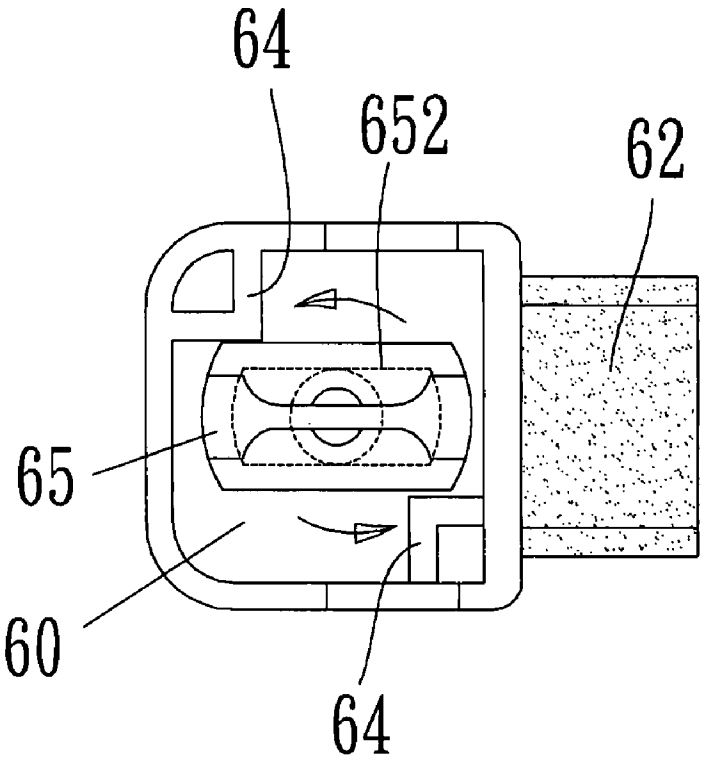
Figures 1, 2:
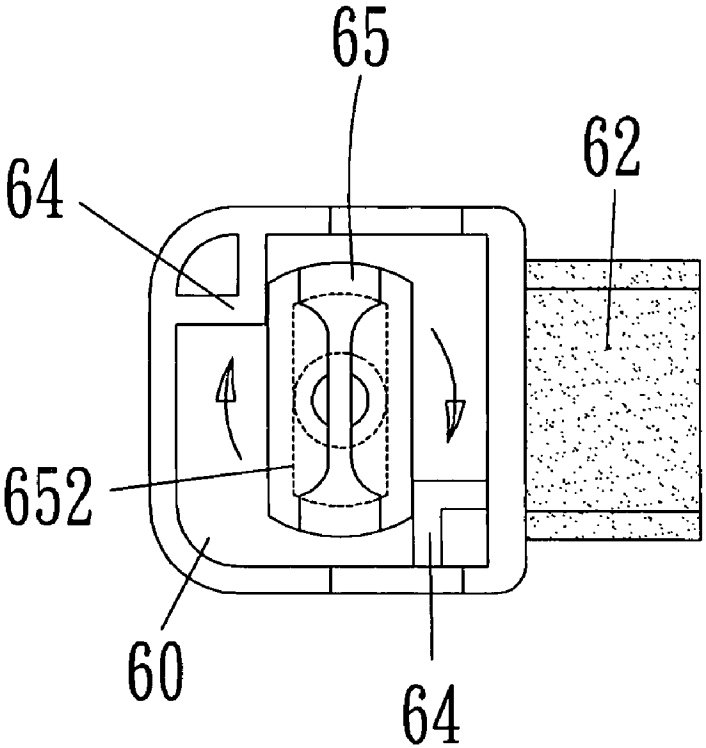
Figure 2:
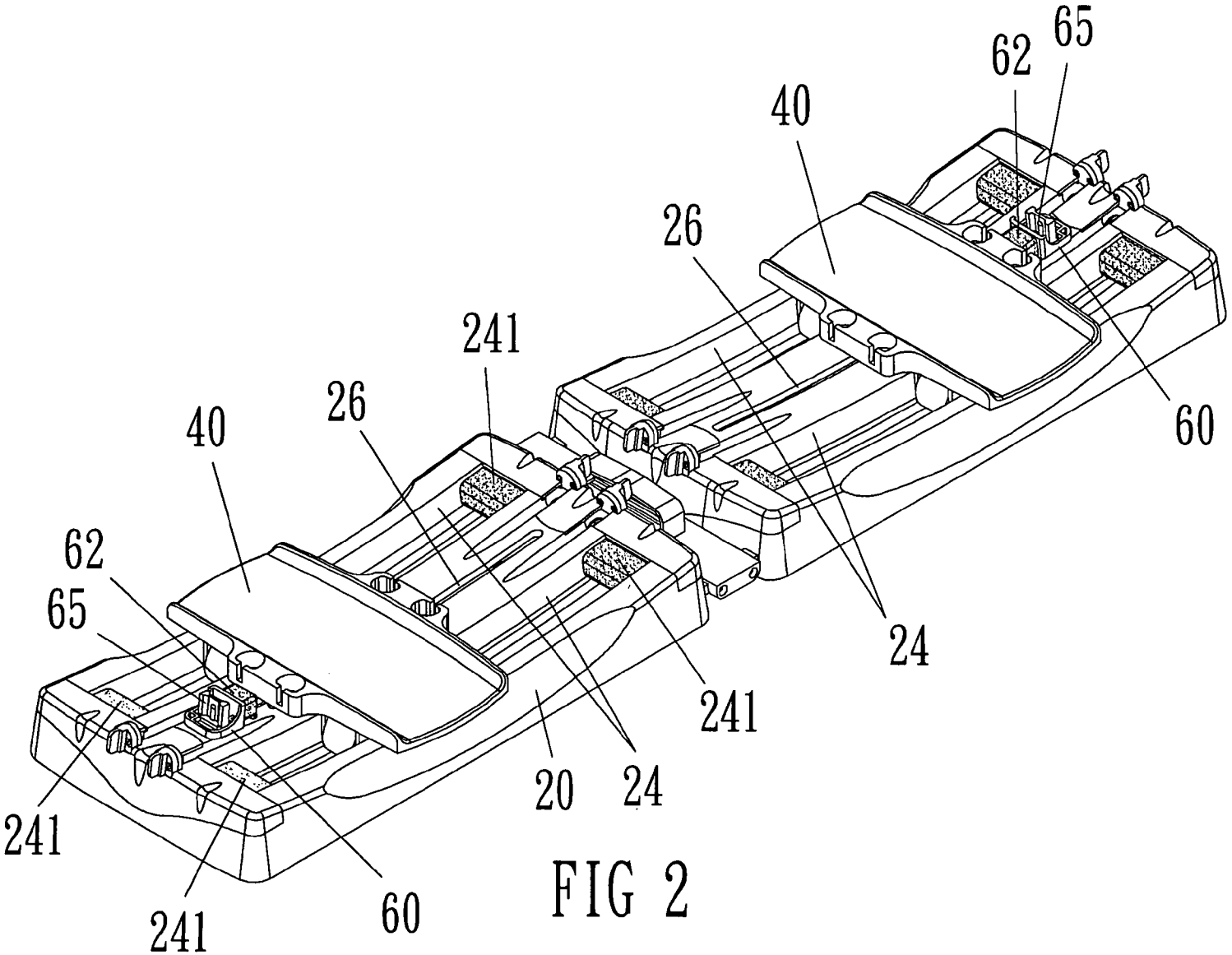
Figure 3:
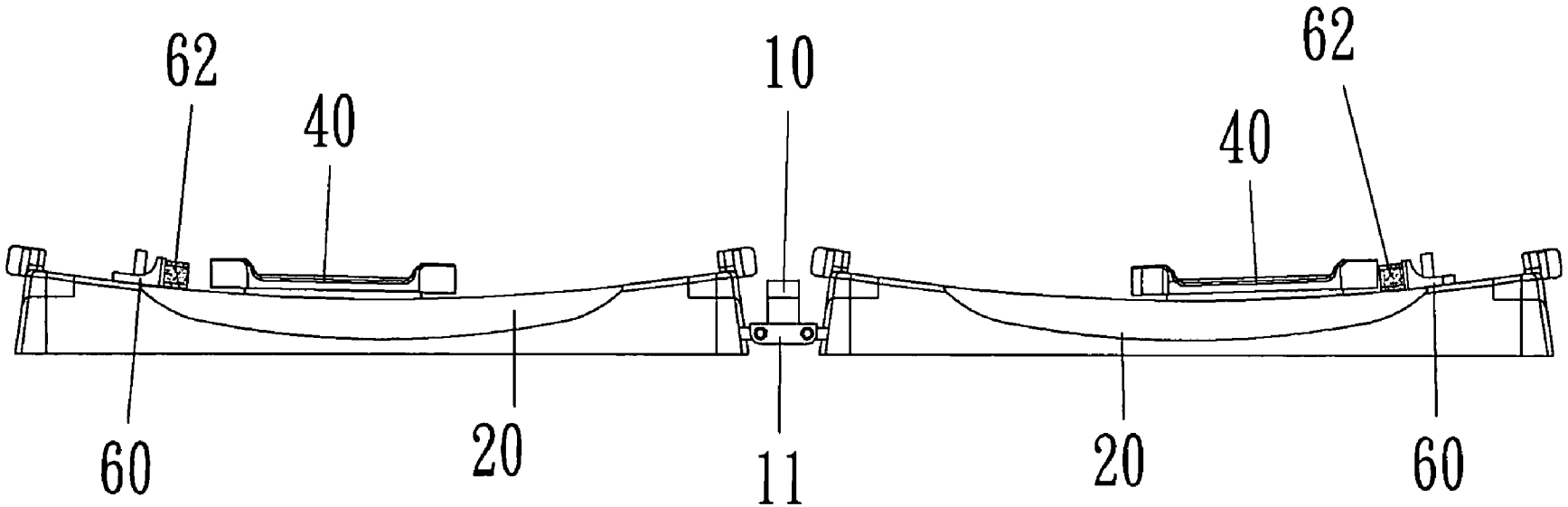
Figure 4:
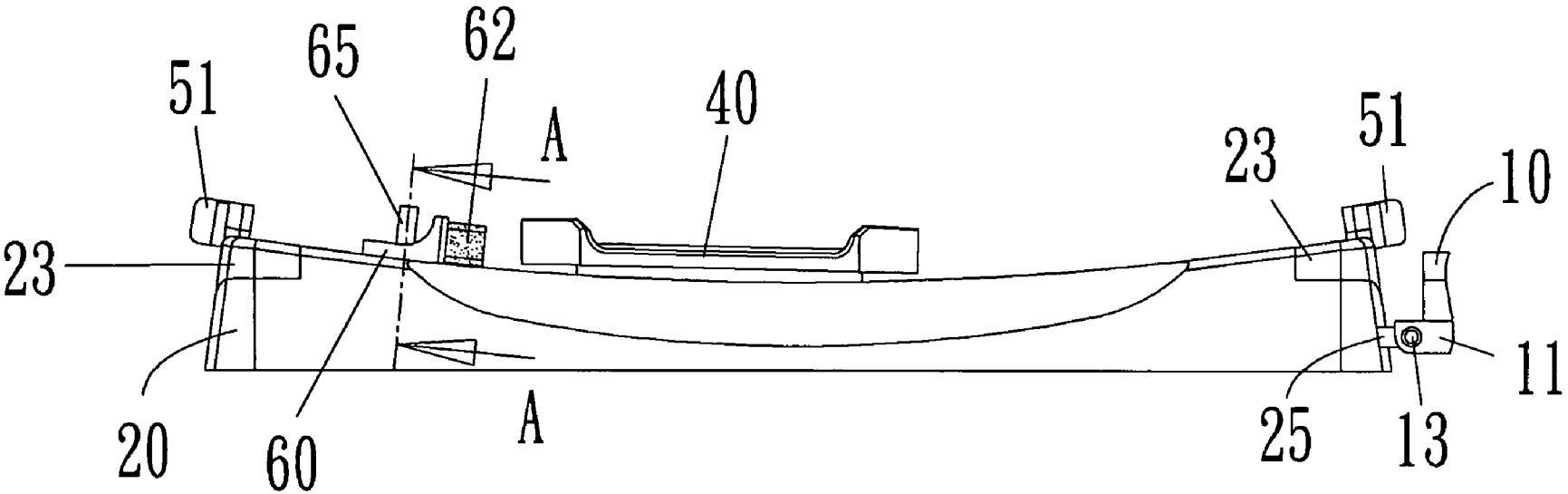
FIG. 4 is an enlarged drawing of left side according to FIG. 3.
Figure 5:
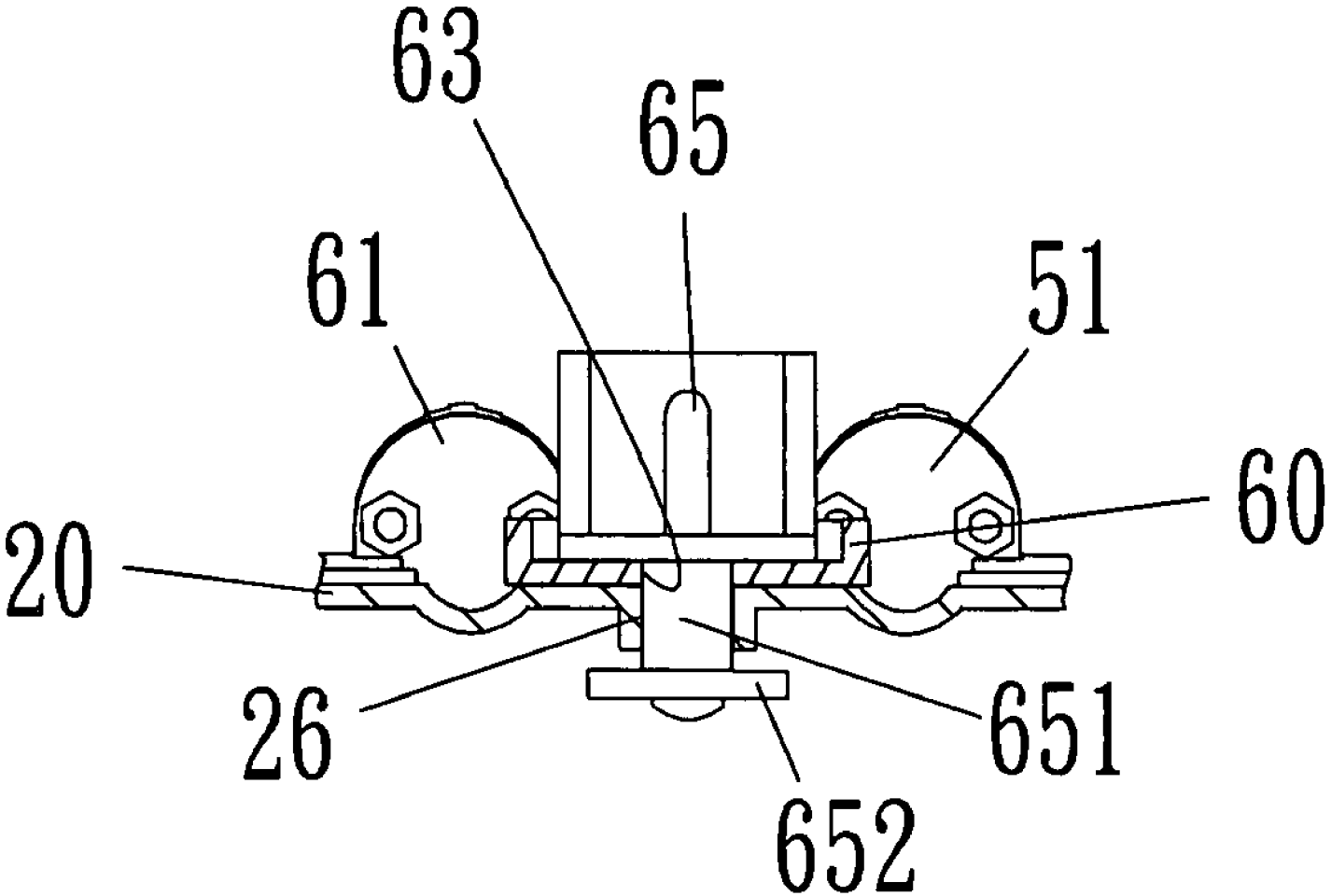
FIG. 5 is a cross-sectional drawing of A-A according to FIG. 4.
Figure 6:
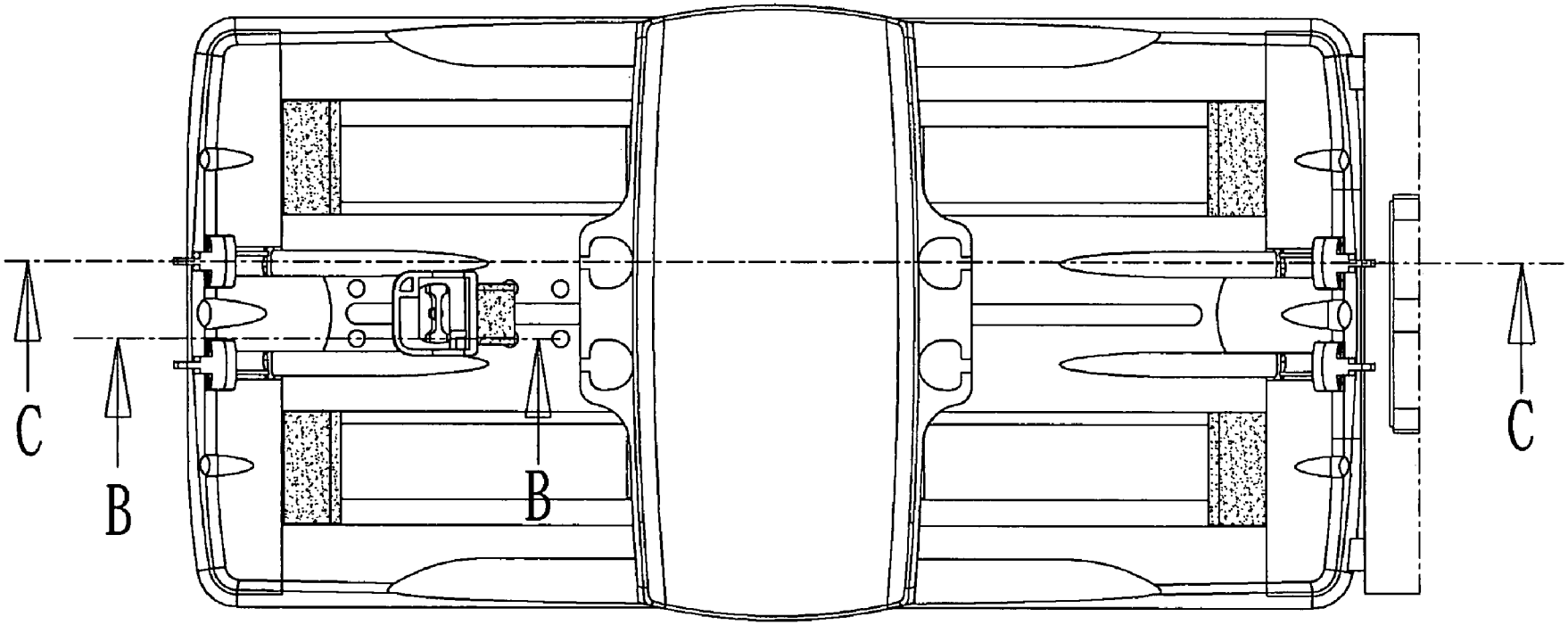
FIG. 6 is a left side top view of the structure according to a preferred embodiment of the' invention.
Figure 7:
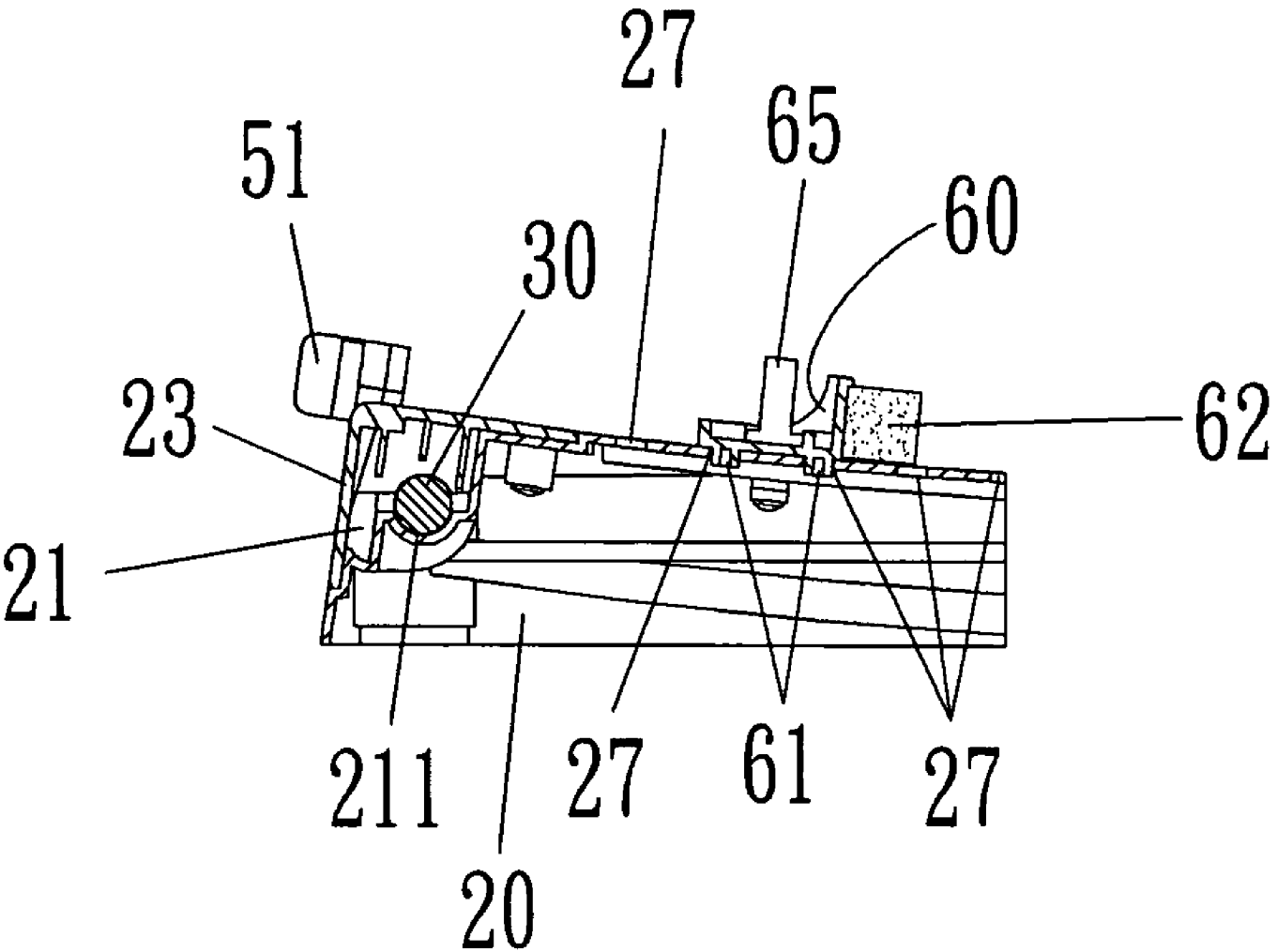
FIG. 7 is a cross-sectional drawing of B-B according to FIG. 6.
Figure 8:
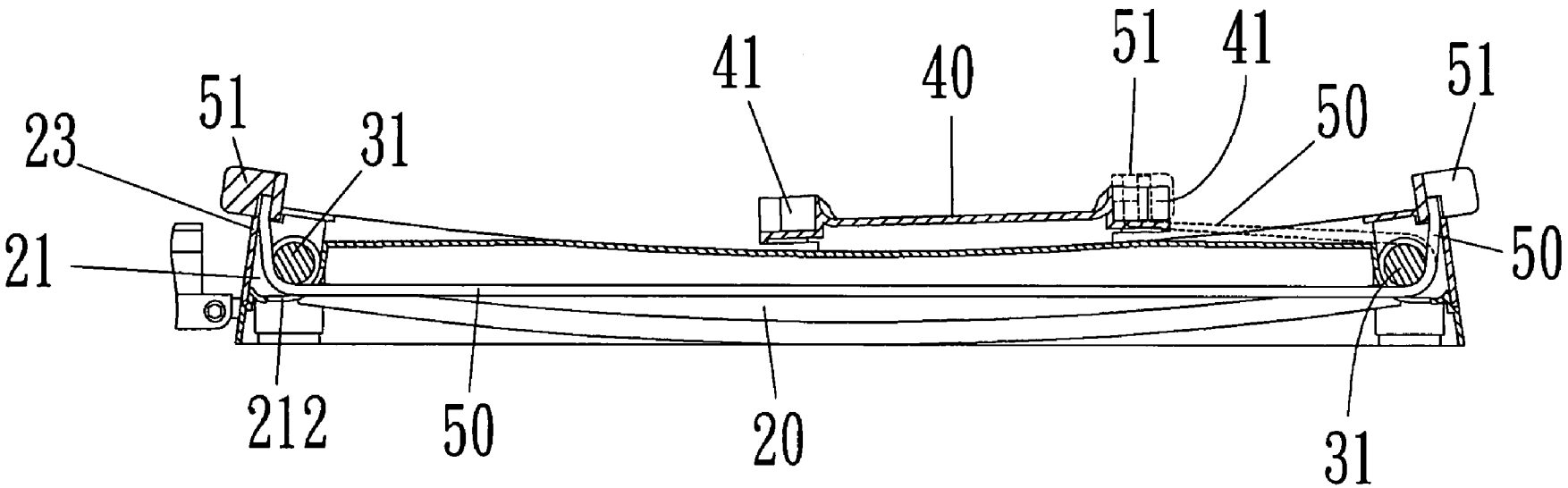
FIG. 8 is a cross-sectional drawing of C-C according to FIG. 6.

In addition, after each cylinder 61 at the bottom portion of the limit seat 60 is fit to each positioning circular hole 27, the regulation member 65 is rotated to allow the long blocking plate 652 at the bottom portion of the regulation member 65 to be vertical (as shown in FIG. 5) the long channel 26, thereby positioning the limit seat 60 without any movement. When the regulation member 65 is rotated to allow the long blocking plate 652 of the bottom portion to be vertical the long channel 26, a diagonal edge of the regulation member 65 can lean against the relative side edge of the predetermined diagonal blocking piece 64 for positioning (as shown in FIGS. 2-2). When the user would like to change each cylinder 61 of the limit seat 60 to fit into other positioning circular holes 27, the long blocking plate 652 at the bottom portion of the regulation member 65 and the long channel 26 are arranged in parallel state by rotating the regulation member 65. Moreover, the limit seat 60 can be upwardly pulled and completely ejected from the long channel 26. When the long blocking plate 652 at the bottom portion of the regulation member 65 and the long channel 26 are arranged in parallel state by rotating the regulation member 65, another diagonal edge of the regulation member 65 can lean against another relative side edge of another predetermined diagonal blocking piece 64 (as shown in FIGS. 1-3) for positioning.

Although the features and advantages of the embodiments according to the preferred invention are disclosed, it is not limited to the embodiments described above, but encompasses any and all modifications and changes within the spirit and scope of the following claims.

What is claimed is:

1. A stretching exercise apparatus comprising:

a carry handle having two ends pivotally connected to symmetric long bottom seats, two short side edges of the long bottom seats having symmetric roller sets covered with an outer cover, upper surfaces of the long bottom seats having symmetric guiding slots near two long side edges of the long bottom seats, at least one long channel disposed between the symmetric guiding slots, two sides of the two long channels having multiple symmetrically positioning circular holes spaced at equivalent intervals and near correspondingly outer ends of the long bottom seats;

at least two sets of symmetric casters, disposed to bottom portions of two pedals, for fitting the symmetric guiding slots, two sides of the pedal having two sets of symmetric fastening slots;

a plurality of flexible riggings respectively disposed inside the two long bottom seats, at least one flexible rigging having two ends wound to rears of the roller sets, blocking members connected to ends of the flexible riggings and capable of being blocked to an upper portion of the outer cover or regulated in the fastening slots at corresponding ends of the pedals; and a limit seat having cylinders at four end angles of a bottom portion of the limit seat, the four cylinders fit to the positioning circular holes of two sides of the long channels so that variations of strokes and distances generated by the pedals relatively moving within the guiding slots are changed by regulating each cylinder of the limit seat inserted into the positioning circular holes at different positions.

2. The stretching exercise apparatus as claimed in claim 1, wherein a limit plate is locked to a center position of the bottom portion of the pedal, and an upper portion of the limit plate has symmetric connection cylinders that are accommodated in the long channel of the long bottom seat, and a width of the limit plate is greater than a width of the long channel so that the pedal is limited by a blocking of the limit plate.

3. The stretching exercise apparatus as claimed in claim 2, wherein two sides of the limit plate has two axles, and a portion of upper surfaces of the two axles is attached to a bottom surface of the long channel.

4. A stretching exercise apparatus comprising:

a carry handle having two ends pivotally connected to symmetric long bottom seats capable of being horizontally unfolded and folded, two long side edges of upper surfaces of the long bottom seats having symmetric guiding slots;

two pedals, wherein bottom portions of the two pedals respectively have at least two sets of symmetric casters fit to the symmetric guiding slots, and two sides of upper portions of the pedals have two sets of symmetric fastening slots;

at least one or more than one flexible rigging disposed inside the two long bottom seats, at least one flexible rigging having two ends respectively connected to a blocking member capable of being blocked to an outer cover of the long bottom seat or regulated in the fastening slots of corresponding end of the pedal to allow the pedal to generate a damper effect.

5. The stretching exercise apparatus as claimed in claim 4, wherein two short side edges of the long bottom seat comprise a symmetric roller set capable of being wound by the flexible rigging.

6. The stretching exercise apparatus as claimed in claim 5, wherein an upper portion of the symmetric roller set is covered with an outer cover.

7. The stretching exercise apparatus as claimed in claim 4, further comprising at least one long channel disposed between the symmetric guiding slots on upper portion of the symmetric long bottom seat, a plurality of symmetric positioning circular holes spaced at equivalent intervals and disposed to two sides of the two long channels, two limit seats respectively connected to the long bottom seat, wherein four end angles of a bottom portion of the limit seat comprise four cylinders, and the four cylinders are fit to the plurality of positioning circular holes at two sides of the long channel so that variations of stroke and distance generated by the pedal relatively moving within the guiding slot are changed by regulating each cylinder of the limit seat inserted into the plurality of positioning circular holes at different positions.

8. The stretching exercise apparatus as claimed in claim 7, wherein a side of an upper end of the limit seat comprises a flexible pad for relatively leaning against the pedal.

9. The stretching exercise apparatus as claimed in claim 4, wherein elastic pads are fastened to two ends of each guiding slot of the long bottom seat and leaning against the casters to absorb shocks and generate buffer effects.

10. The stretching exercise apparatus as claimed in claim 7, wherein a side of an upper end of the limit seat has a circular aperture; and a circular cylinder is extended from a bottom portion of a regulation member to fit in the circular aperture to perform an angle rotation, and a long blocking plate is formed from a terminal of the circular cylinder, and a short edge of the long blocking plate is smaller than a width of the long channel of the long bottom seat, and a long edge of the long blocking plate is greater than the width of the long channel.

11. The stretching exercise apparatus as claimed in claim 7, wherein symmetric blocking pieces are disposed to a predetermined inclined diagonal at a circumference of the circular aperture on an upper end of the limit seat and provided for leaning against and limiting the regulation member.

* * * * *